US009468241B2

(12) United States Patent
Harber et al.

(10) Patent No.: US 9,468,241 B2
(45) Date of Patent: Oct. 18, 2016

(54) VARIABLE COMPRESSION GARMENT

(71) Applicant: Nike, Inc., Beaverton, OR (US)

(72) Inventors: Edward Louis Harber, Portland, OR (US); Irena Ilcheva, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 919 days.

(21) Appl. No.: 13/626,558

(22) Filed: Sep. 25, 2012

(65) Prior Publication Data

US 2014/0082815 A1 Mar. 27, 2014

(51) Int. Cl.
*A41D 13/00* (2006.01)
*A41B 11/00* (2006.01)

(52) U.S. Cl.
CPC ..... *A41D 13/0015* (2013.01); *A41B 11/003* (2013.01)

(58) Field of Classification Search
CPC ..... A41D 13/0015; A41B 11/003
USPC ..... 2/69, 227, 239–242, 312
See application file for complete search history.

(56) References Cited

U.S. PATENT DOCUMENTS

| | | | | |
|---|---|---|---|---|
| 5,978,966 | A | 11/1999 | Dicker et al. | |
| 6,123,681 | A | 9/2000 | Brown | |
| 6,194,629 | B1 | 2/2001 | Bernhard | |
| 6,311,334 | B1 | 11/2001 | Reinhardt | |
| 6,892,733 | B2 * | 5/2005 | Clinton | A61F 5/0109 128/878 |
| 7,025,738 | B2 | 4/2006 | Hall | |
| 7,135,007 | B2 | 11/2006 | Scott | |
| 7,636,950 | B2 * | 12/2009 | Melhart et al. | 2/69 |
| 7,886,367 | B2 | 2/2011 | Chapuis et al. | |
| 7,908,674 | B2 * | 3/2011 | Jones | 2/242 |
| 2002/0082542 | A1 | 6/2002 | Hall | |
| 2006/0085894 | A1 | 4/2006 | Yakopson et al. | |
| 2007/0022510 | A1 * | 2/2007 | Chapuis et al. | 2/69 |
| 2010/0004563 | A1 * | 1/2010 | Lipshaw | 600/587 |
| 2010/0130903 | A1 | 5/2010 | Rock | |
| 2011/0302686 | A1 | 12/2011 | Chapuis | |

FOREIGN PATENT DOCUMENTS

| | | | |
|---|---|---|---|
| EP | 1125512 | A1 | 8/2001 |

OTHER PUBLICATIONS

International Preliminary Report on Patentability dated Apr. 9, 2015 in Application No. PCT/US2013/061421, 8 pages.
Notification of Transmittal of the International Search Report and the Written Opinion of the International Searching Authority, or the Declaration in PCT/US13/061421, dated Feb. 18, 2014, 13 pages.
European Search Report dated Feb. 12, 2016 in Application No. 13841650.8, 10 pages.

* cited by examiner

*Primary Examiner* — Katherine Moran
(74) *Attorney, Agent, or Firm* — Shook, Hardy & Bacon, LLP

(57) ABSTRACT

Variable compression garments may use an elastomer such as silicone printed on a textile to create a varying amount of compressive force along a limb. Greater amounts of elastomer may be used to create greater amounts of compressive force.

19 Claims, 3 Drawing Sheets

VARIABLE COMPRESSION GARMENT

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to sports garments. More particularly, the present invention relates to variable compression sports garments worn by athletes during training and/or competition or after training and/or competition.

BACKGROUND OF THE INVENTION

Many athletes wear compression garments after or even during physical exertion, such as athletic training or competition, based upon the athlete's perception that compression garments help alleviate fatigue and/or assist recovery after exertion. Particularly desirable to many athletes are variable compression garments that provide an amount of compression that varies along the length of an athlete's extremity or limb, such as an arm or a leg. Often, an athlete desires higher compression at the end of a limb, such as at an ankle or at a wrist, and less compression closer to the core of the athlete's body, such as the upper thigh or upper arm. Such variable compression has been achieved in garments in various manners that are impractical and/or uncomfortable. For example, some garments use various bladders that may be filled with air or other liquids to create a compression gradient. The use of different yarns or different knit types over the length of a garment may also be used to generate a compression gradient. Various types of straps either permanently or temporarily incorporated into a garment have also been used to vary the compression provided by a garment. Unfortunately, such garments are typically complicated to manufacture, difficult to don, impractical for wear during training or other exertion, and uncomfortable and even impractical to wear for recovery.

BRIEF SUMMARY OF THE INVENTION

The present invention provides variable compression garments using an elastomer overlaid on a stretchable textile to jointly provide a desired amount of compression along a garment. By varying the amount of elastomer used at different locations along a garment, varying degrees of compression may be provided along the garment. One example of an appropriate elastomer is silicone, which may be printed or otherwise applied to the textile used to form a garment. Such printing or other application may occur either after the garment has been formed from the base textile or before the garment has been formed. The silicone or other elastomer may be applied to form continuous rings around the garment to exert an inward compressive force on the portion of the body wearing the garment corresponding to each ring. The total compressive force applied at any particular location by the garment will therefore be the sum of the compressive force provided by the elastomer and the compressive force applied by the base textile. In addition to rings of elastomer circling the garment to provide a compressive force, connecting sections of elastomer may join the rings to one another along all or part of the length of the garment. Such connecting portions may facilitate the donning of the garment by preventing the base textile from stretching excessively as the garment is placed upon the wearer's extremities. Garments in accordance with the present invention may comprise tights, sleeves for arms, sleeves for legs, socks, shirts, or any other type of garment that may be worn on the portion of an athlete's anatomy where compression is desired.

BRIEF DESCRIPTION OF THE DRAWINGS

The present invention is described in detail below with reference to the attached drawing figures, wherein.

DETAILED DESCRIPTION OF THE INVENTION

The present invention provides variable compression garments and methods of fabricating variable compression garments. Garments and methods for fabricating such garments in accordance with the present invention may be used to provide a highly tunable degree of compression that may vary along the length of a garment.

Figure 1:
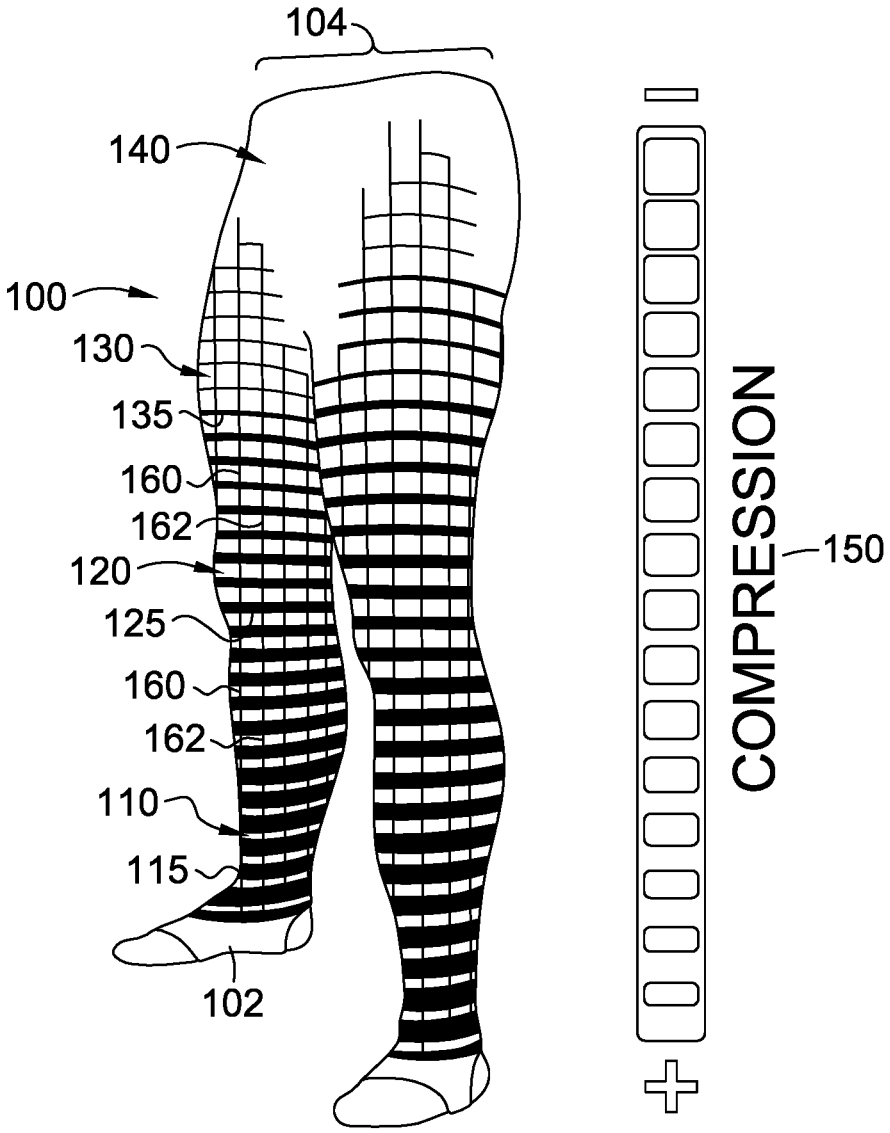
FIG. 1 illustrates variable compression tights in accordance with the present invention and the amount of compressive force provided by the tights along the legs of the wearer.

Referring now to FIG. 1, variable compression tights 100 in accordance with the present invention are illustrated. While FIG. 1 illustrates the particular example of tights 100, the present invention may be implemented in a variety of garment types, such as shirts, sleeves, socks, etc. Further, the appearance and functional compression of variable compression tights in accordance with the present invention may differ from the example depicted in FIG. 1. Tights 100 may be worn by an athlete or other wearer such that stirrups 102 are engaged by the feet of the wearer. Stirrups 102 are optional, but may be useful in tights, particularly compression tights, to secure the tights 100 at the feet of the wearer and to provide an anchor to facilitate donning. As can be seen in FIG. 1, the tights 100 may possess an elastomer overlay, described further below, that varies from the ankle area 110 of the wearer to the waist area 140 of the wearer, with differing amounts of elastomer along the length of the legs of the wearer generating different amounts of compression. For example, the amount of elastomer provided may be different at the ankle area 110 than at the knee area 120, which may also be different from the elastomer amount at the thigh area 130, which may be different than the elastomer amount at the waist area 140.

More generally, a garment in accordance with the present invention such as tights 100 may be thought of as providing varying amounts of compression along an extremity of the wearer with the amount of compression provided varying from the end of the extremity distant from the core of the wearer's body to a minimum compression near the core of the wearer's body. As can be seen in the example of FIG. 1, elastomer rings such as first ring 115 located near the ankle region 110 of the wearer may have a first thickness, while a second elastomer ring 125 located near the knee region 120 of the wearer may have a second thickness that is less than the first thickness. Meanwhile, a third elastomer ring 135 located near the thigh region 130 of the wearer may have a third thickness that may be less than the first thickness of the first ring 115 and the second thickness of the second ring 125, while a further region of the garment such as waist region 140 may possess no elastomer rings at all, relying only upon the compressive force of the base textile itself to provide any compression desired in that region. As illustrated by relative compression gradient 150 in FIG. 1, the amount of compression provided by tights 100 varies from the greatest compression at the ankles of the wearer to the least compression at the waist of the wearer. For example, tights 100 may provide 20 mmHg of compression at the ankles 110, 10 mmHg at the knees 120, and essentially 0 mmHg at the waist 140 or hips. By way of another example, tights 100 may provide between 20 and 30 mmHg of compression at the ankles 110, between 10 and 15 mmHg at the knees 120, and between 0 and 5 mmHg at the waist 140 or hips. By way of yet further example, tights 100 may provide between 30 and 40 mmHg at the ankles 110, between 10 and 20 mmHg at the knees 120, and between 0 and 5 mmHg at the waist 140 or hips. Some compression gradient configurations possible within the scope of the present invention may require or benefit from prescription guidance from an appropriate healthcare practitioner. The compression gradient of tights 100 or other garments in accordance with the present invention may be substantially linear in its variance, as in the examples provided herein, but may vary in non-linear fashions as well, for example with high compression at the ankles 110, equally or nearly as equally high compression at the knees 120, rapidly decreasing compression over the thighs 130, and then nearly no compression at the waist 140. While other compression gradients may be desired, for example with higher compression near the core of the wearer and less compression at the end of the limbs of a wearer, the present example illustrated in FIG. 1 represents only one example of a compression gradient that may be desired by some wearers. Additionally, the first ring 115, second ring 125, and third ring 135 may be joined together by a first plurality of connecting portions 160 and a second plurality of connecting portions 162. Further, the first plurality of connecting portions 160 and second plurality of connecting portions 162 may be referred to together as at least two pluralities of connecting elastomer portions 160 and 162. The at least two pluralities of connecting portions 160 and 162 may connect the plurality of elastomer rings around the circumference of the right leg portion and the left leg portion. Additionally, in accordance with one aspect, each of the plurality of connecting portions joins at least two of the first ring 115, the second ring 125, and the third ring 135 on the base textile.

Figure 2:
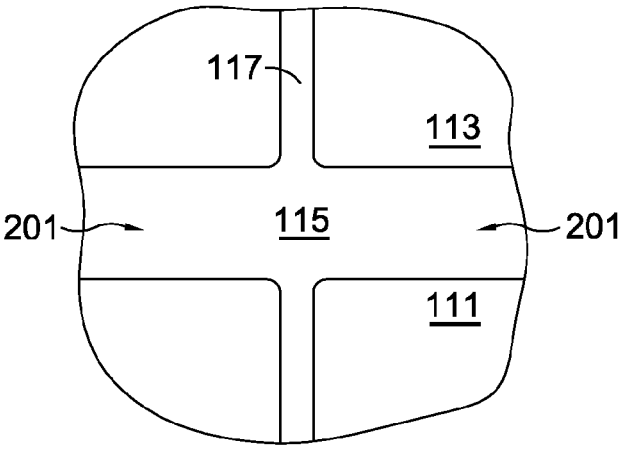
FIG. 2 illustrates an example of a first elastomer ring and connecting portions in accordance with the present invention.

Referring now to FIG. 2, an example of a first elastomer ring 115 is illustrated. First elastomer ring 115 may have a first thickness 201 that provides a corresponding amount of compressive force. First elastomer ring 115 may be joined with elastomer rings above and/or below it on the garment by a connecting portion 117. Numerous additional connecting portions other than connecting portion 117 illustrated in FIG. 2 may be provided around the extent of an elastomer ring. Below 111 elastomer ring 115, the compressive force of the garment may be provided only by the base textile, while directly above 113 elastomer ring 115, the compressive force of the garment may likewise be provided only by the base textile. The amount of compressive force provided by elastomer ring 115 may be determined by the thickness 201 of elastomer ring 115. Thickness 201 may comprise the height and/or width of the elastomer ring, as both the height from the base textile and the width along the base textile may be varied in applying the elastomer. While first elastomer ring 115 illustrated in the example of FIG. 2 roughly corresponds to the ankle area 110 illustrated in FIG. 1, first elastomer 115 may correspond to any other region of a garment and any other portion of the wearer's body when the garment is worn.

Figure 3:
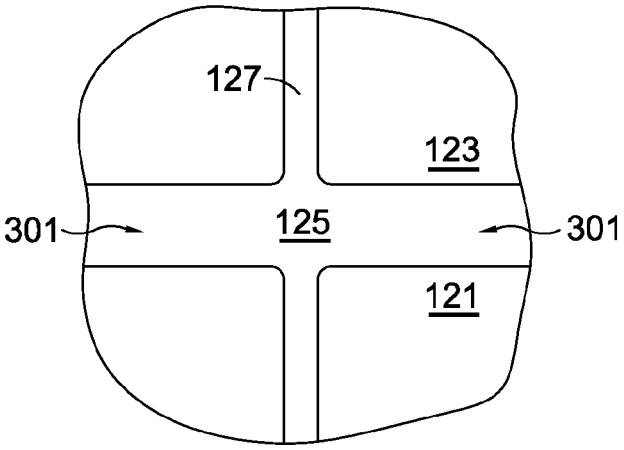
FIG. 3 illustrates a second example of an elastomer ring and connecting portions in accordance with the present invention.

Referring now to FIG. 3, a second elastomer ring 125 is illustrated. The example second elastomer ring 125 of FIG. 3 may correspond to the knee region 120 of the tights 100 illustrated in the example of FIG. 1, but may correspond to any other region of a garment or any other portion of a wearer's anatomy when the garment is worn. As illustrated in the example of FIG. 3, second elastomer ring 125 has a second thickness 301, such second thickness 301 being less than first thickness 201 illustrated with regard to FIG. 2. Immediately below 121 second elastomer ring 125 and immediately above 123 second elastomer ring 125, the compressive force of the garment is provided only by the base textile. Meanwhile, within second elastomer ring 125, the compressive force of the garment is provided by both the base textile and the elastomer ring 125. The amount of compressive force provided by second elastomer ring is determined by the thickness 301 of second elastomer ring 125. Similar to that illustrated in FIG. 1, one or more connecting portions 127 may join elastomer ring 125 with rings above and/or below elastomer ring 125 on the garment.

Figure 4:
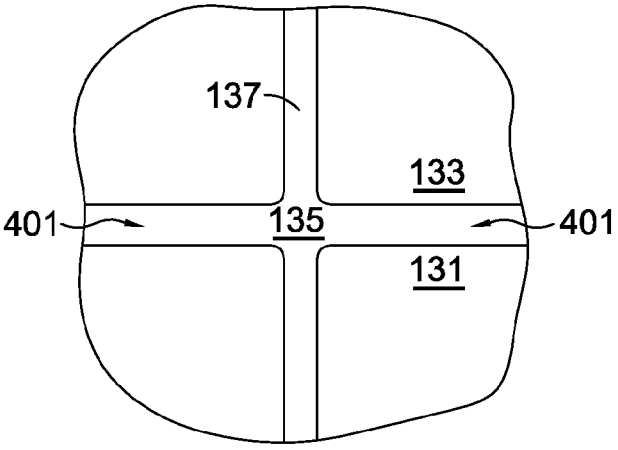
FIG. 4 illustrates a third example of an elastomer ring and connecting portions in accordance with the present invention.

Referring now to FIG. 4, a third elastomer ring 135 having a third thickness 401 is illustrated. In the present example, third elastomer ring 135 may generally correspond to the thigh region 130 of the wearer, but the example of third elastomer ring 135 may correspond to any other region of a garment or portion of the anatomy of the person wearing such a garment. As illustrated in the example of FIG. 4, third elastomer ring 135 may have a third thickness 401 that determines the amount of compressive force applied by third elastomer ring 135. Within third elastomer ring 135, the compressive force applied by the garment will be the sum of the force exerted by elastomer ring 135 and the base textile. Immediately below 131 and above 133 third elastomer ring 135, the compressive force applied by the garment is only that produced by the base textile. Once again, one or more connecting portions 137 may join elastomer ring 135 to rings immediately above and/or below it.

While FIGS. 2-4 illustrate only three discrete examples of rings with three specific elastomer thicknesses, the present invention may utilize any number of elastomer rings and thicknesses. For example, no two elastomer rings on a garment in accordance with the present invention need have the same thickness. In other words, the compressive force exerted by a garment in accordance with the present invention may vary quite gradually along the garment, without sudden changes between discrete zones or bands of a garment. In an exemplary aspect, the variable compression tights may comprise at least two pluralities of elastomer rings which extend around a circumference of each of the right leg portion and the left leg portion of the tights. In this aspect, the elastomer rings may be in a spaced apart relationship along each of the right leg portion and left leg portion. The two pluralities of elastomer rings extending around the circumference of the right leg portion may be horizontal to the two pluralities of elastomer rings extending around the circumference of the left leg portion when the tights are in the as-worn configuration. In another aspect, each of the right leg portion and the left leg portion may be formed of a single piece of the base textile such that a line extending from the ankle portion to the upper tight portion of the athlete does not intersect a seam when the variable compression tights are in the as-worn configuration. Meanwhile, connecting portions such as, but not limited to, exemplary connecting portions 117, 127, 137 may join the various elastomer rings provided on the garment in accordance with the present invention to facilitate donning of the garment. Additionally the exemplary connecting portions 117, 127 and 137 may have less stretchability than the base textile. Such connecting portions may effectively tug the elastomer rings along or over, for example, a limb of a wearer when the garment is donned, preventing bunching or undue difficulty inserting a limb into the garment.

Figure 5:
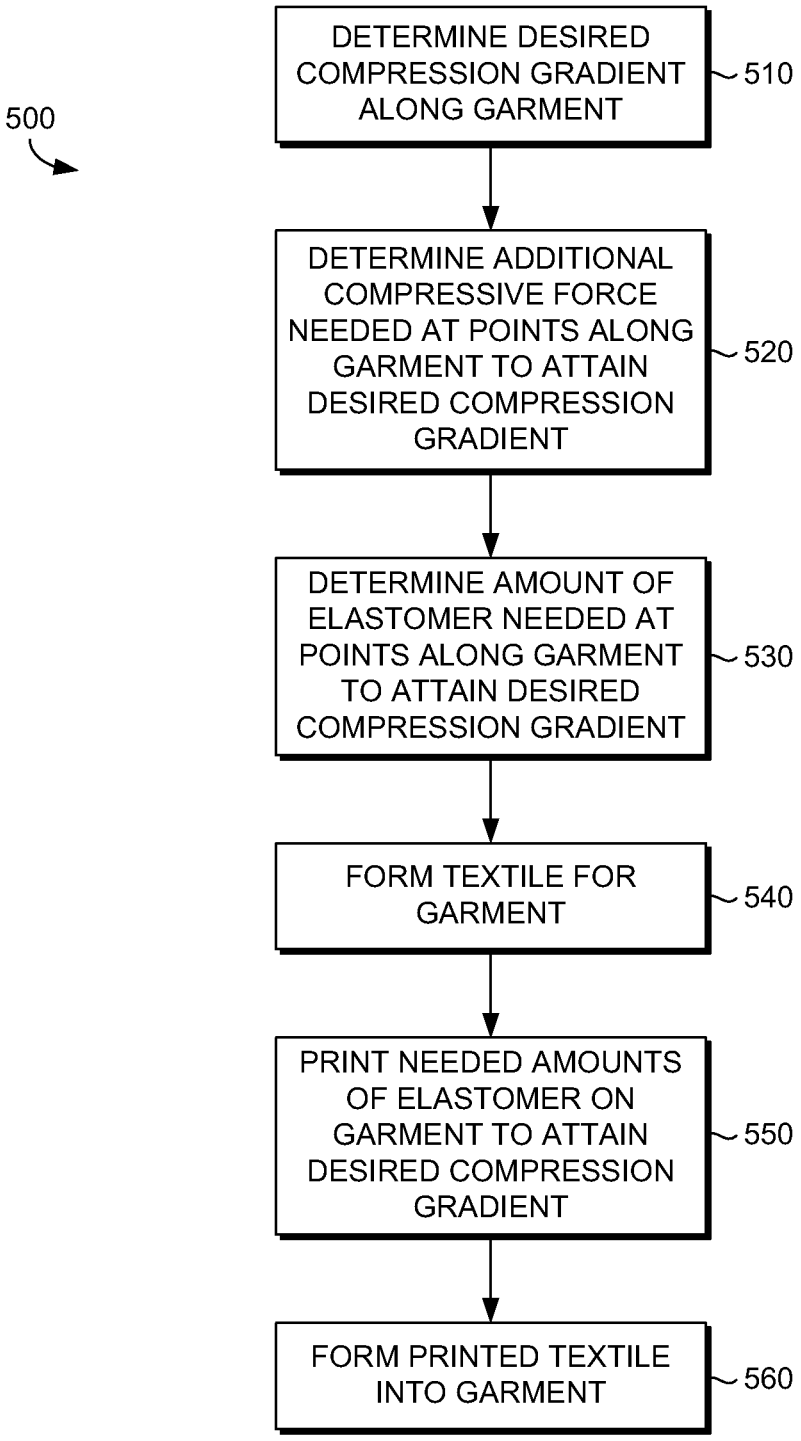
FIG. 5 illustrates an example of a method for fabricating a variable compression garment in accordance with the present invention.

Referring now to FIG. 5, an example of a method 500 for fabricating a garment in accordance with the present invention is illustrated. Method 500 may begin with step 510 of determining the desired compression gradient along the garment. Step 510 may comprise, for example, determining how much compressive force is desired at different locations along the leg, arm, or other anatomical portion of a wearer. Step 510 may be impacted by considerations such as, but not limited to, the size and conditioning state of the intended wearer, the type of athletic exertion involved, the training stage for which the garment is intended to be worn, etc. In step 520, the additional compressive force needed at points along the garment to attain the desired compression gradient may be determined. Step 520 may be accomplished by considering the compression and compression gradient desired in step 510 and the compressive force provided by a selected base textile. In step 530, the amount of elastomer required to achieve the desired amount of compression at locations along the garment. In step 540, the garment may be formed from the textile, by stitching, gluing, or any other process. In step 550, the textile may be formed into a garment. Step 550 may involve stitching, the use of adhesives, or any other construction technique. In step 560, the needed amounts of elastomer may be printed at locations along the garment to attain the desired compression gradient. Step 560 may use any type of printing process to apply an elastomer, such as screen printing, ink jet printing, etc.

Having thus described the invention, what is claimed is:

1. A compression garment comprising:

a base textile that is adapted to encompass a circumference of at least a first portion of an anatomy of a person when the compression garment is in an as-worn configuration, the base textile adapted to exert a first compressive force to the first portion of the anatomy of the wearer; and an elastomer printed onto the base textile, the elastomer comprising:

a plurality of ring portions, each of the plurality of ring portions having a first edge and a second edge adapted to encompass the circumference of the at least the first portion of the anatomy of the person when the compression garment is in the as-worn configuration, the each of the plurality of ring portions adapted to exert a second compressive force to the first portion of the anatomy of the wearer, with a thickness of the elastomer printed onto the base textile varying for different ring portions of the plurality of ring portions and the second compressive force varying in relationship to the thickness of the each of the plurality of ring portions, and a plurality of connecting portions that are adapted to not encompass the circumference of the at least the first portion of the anatomy of the person when the compression garment is in the as-worn configuration, each of the plurality of connecting portions having a first edge and a second edge, wherein the plurality of connecting portions are substantially perpendicular to the plurality of ring portions, and wherein the each of the plurality of connecting portions joins at least two of the plurality of ring portions, the total compressive force applied by the compression garment at a given location along the first portion of the anatomy of the person when the compression garment is in the as-worn configuration being the sum of the first compressive force and the second compressive force at that location of the garment.

2. The compression garment of claim 1, wherein the elastomer comprises a silicone.

3. The compression garment of claim 2, wherein the silicone is printed using a screen printing process.

4. The compression garment of claim 1, wherein the thickness of the each of the plurality of ring portions varies from a first portion of the compression garment to a second portion of the compression garment.

5. The compression garment of claim 4, wherein the thickness of the each of the plurality of ring portions varies from thickest at the first portion of the compression garment and thinnest at the second portion of the compression garment, and wherein the first portion of the compression garment corresponds to the wearer's extremities and the second portion corresponds to the wearer's lower torso when the compression garment is in the as-worn configuration.

6. The compression garment of claim 5, wherein the thickness of the each of the plurality of ring portions varies linearly.

7. A pair of variable compression tights comprising:

a base textile having a right leg portion formed from the base textile and adapted to encompass a right leg of an athlete, and a left leg portion formed from the base textile and adapted to encompass a left leg of the athlete when the variable compression tights are in an as-worn configuration, the base textile being a stretchable material adapted to provide a first compressive force to the right leg and left leg of the athlete when the variable compression tights are in the as-worn configuration, each of the right leg portion and the left leg portion of the variable compression tights adapted to extend from at least an ankle portion to an upper thigh portion of the athlete when the variable compression tights are in the as-worn configuration;

at least two pluralities of elastomer rings extending around a circumference of each of the right leg portion and the left leg portion of the tights, the elastomer rings being in a spaced apart relationship along the each of the right leg portion and the left leg portion, each of the elastomer rings adapted to exert a compressive force that combines with the first compressive force to produce a total compressive force of the tights at a given location along the right leg and left leg respectively of the athlete when the variable compression tights are in the as-worn configuration; and at least two pluralities of connecting elastomer portions connecting the plurality of elastomer rings around the circumference of the right leg portion and the left leg portion, respectively, the connecting elastomer portions having less stretchability than the base textile.

8. The pair of variable compression tights of claim 7, wherein each ring of the at least two pluralities of elastomer rings extending around the circumference of each of the right leg portion and the left leg portion has a thickness, the thickness determining the compressive force exerted by that elastomer ring.

9. The pair of variable compression tights of claim 8, wherein the thickness of the rings in each of the at least two pluralities of elastomer rings varies from a maximum at a portion of the variable compression tights adapted to encompass the ankle portion of the athlete to a minimum at a portion of the variable compression tights adapted to encompass the upper thigh portion of the athlete when the variable compression tights are in the as-worn configuration.

10. The pair of variable compression tights of claim 9, wherein the elastomer rings comprise silicone rings.

11. The pair of variable compression tights of claim 9, wherein the elastomer rings are screen printed onto the base textile.

12. The pair of variable compression tights of claim 9, wherein the elastomer rings and the connecting elastomer portions are screen printed onto the base textile.

13. The pair of variable compression tights of claim 12, wherein the elastomer rings and the connecting elastomer portions are screen printed onto the base textile after the base textile is formed into the right leg portion and the left leg portion.

14. The pair of variable compression tights of claim 9, wherein the two pluralities of elastomer rings extending around the circumference of the right leg portion and the two pluralities of elastomer rings extending around the circumference of the left leg portion are substantially aligned along a horizontal plane when the tights are in the as-worn configuration.

15. The pair of variable compression tights of claim 9, wherein each of the right leg portion and the left leg portion are formed of a single piece of the base textile such that a line extending from the ankle portion to the upper thigh portion of the athlete does not intersect a seam when the variable compression tights are in the as-worn configuration.

16. A method for forming a variable compression garment, wherein the variable compression garment is adapted to overlie portions of a body of a person wearing the variable compression garment, the method comprising:

providing a base textile used to form the variable compression garment;

identifying a compression gradient desired across a portion of the variable compression garment, the compression gradient comprising at least:

a first compression desired at a first location on the body of the person wearing the variable compression garment, a second compression desired at a second location on the body of the person wearing the variable compression garment, and a rate of change in the compression desired between the first location and the second location;

determining the compression provided by the base textile at the first location, the second location, and between the first location and the second location when the variable compression garment is worn;

determining an additional amount of compressive force needed at the first location, the second location, and between first location and the second location in order to create the desired compression gradient;

determining a first amount of elastomer needed to form a first elastomer ring having a first edge and a second edge at the first location to exert the additional amount of compressive force needed to create the desired compression gradient, a second amount of elastomer needed to form a second elastomer ring having a first edge and a second edge at the second location to create the desired compression gradient, and at least a third amount of elastomer needed to form at least a third elastomer ring having a first edge and a second edge between the first location and the second location to form the desired compression gradient;

applying elastomer to the base textile in the determined amounts to form at least the first ring, the second ring, and the third ring; and applying an additional amount of elastomer to the base textile to form a plurality of connecting portions, wherein each of the plurality of connecting portions has a first edge and a second edge, wherein the plurality of connecting portions are perpendicular to the first ring, the second ring, and the third ring, and wherein the each of the plurality of connecting portions joins at least two of the first ring, the second ring, and the third ring on the base textile.

17. The method for forming a variable compression garment of claim 16, wherein the elastomer applied to the base textile to form each of the plurality of connecting portions comprises a silicone.

18. The method for forming a variable compression garment of claim 17, further comprising the forming the variable compression garment from the base textile prior to applying the elastomer.

19. The method for forming a variable compression garment of claim 18, wherein forming the variable compression garment from the base textile further comprises cutting portions of the base textile to a desired size and shape and stitching the cut portions to form the variable compression garment.

* * * * *